US006571463B2

(12) United States Patent
Coonrod et al.

(10) Patent No.: US 6,571,463 B2
(45) Date of Patent: Jun. 3, 2003

(54) RIVET CARRIER

(75) Inventors: John S. Coonrod, Rockford, IL (US); John Filz, Rockford, IL (US)

(73) Assignee: Textron Inc., Providence, RI (US)

( * ) Notice: Subject to any disclaimer, the term of this patent is extended or adjusted under 35 U.S.C. 154(b) by 0 days.

(21) Appl. No.: 09/874,798

(22) Filed: Jun. 5, 2001

(65) Prior Publication Data

US 2002/0014422 A1 Feb. 7, 2002

Related U.S. Application Data

(60) Provisional application No. 60/212,306, filed on Jun. 17, 2000.

(51) Int. Cl.[7] ..... B23Q 7/10
(52) U.S. Cl. ..... 29/818; 227/99; 29/809
(58) Field of Search ..... 29/809, 818; 227/99, 227/112

(56) References Cited

U.S. PATENT DOCUMENTS

| | | | | |
|---|---|---|---|---|
| 2,768,763 | A | | 10/1956 | Meilstrup |
| 3,049,713 | A | * | 8/1962 | Pupuy |
| 4,005,519 | A | | 2/1977 | Di Maio et al. |
| 4,494,306 | A | * | 1/1985 | Immonen |
| 4,535,925 | A | * | 8/1985 | Ramey et al. |
| 4,609,134 | A | | 9/1986 | Davern |
| 4,765,175 | A | | 8/1988 | Denham et al. |
| 5,337,463 | A | | 8/1994 | Rossler et al. |
| 5,779,127 | A | * | 7/1998 | Blacket et al. |
| 5,813,114 | A | | 9/1998 | Blacket et al. |
| 6,089,437 | A | | 7/2000 | Blacket et al. |
| 6,164,255 | A | * | 12/2000 | Maas et al. |

FOREIGN PATENT DOCUMENTS

| | | | |
|---|---|---|---|
| EP | 0922538 | | 6/1998 |
| JP | 11156641 A | * | 6/1999 |

* cited by examiner

*Primary Examiner*—Douglas Olms
*Assistant Examiner*—Steven A Blount
(74) *Attorney, Agent, or Firm*—Trexler, Bushnell, Giangiorgi, Blackstone & Marr, Ltd

(57) ABSTRACT

A rivet carrier for use in association with a driver for driving rivets into a work piece. The rivet carrier includes mounting structure for mounting the rivet carrier on the driver. A body portion of the rivet carrier is in communication with the mounting structure for receiving and retaining the rivet for engagement by the driver. Angled rollers are disposed in the body, and there are pivotable arms in the body. A resilient member retainably engages the pivotable arms. The rollers are retained in recesses in the body, and at least a portion of the pivotable arms defines at least a portion of the recesses. Preferably, a pair of outlet vents are provided in the body of the rivet carrier for venting air which is used to drive the rivet. One outlet vent may be proximate the other outlet vent to create laminar air flow.

7 Claims, 4 Drawing Sheets

RIVET CARRIER

RELATED APPLICATION

This application claims the benefit of U.S. provisional application Serial. No. 60/212,306, filed Jun. 17, 2000.

BACKGROUND

This invention generally relates to rivet carriers, and more specifically relates to a rivet carrier which is configured to prevent jamming and reduce turbulence and movement during use.

Rivets are used in a variety of applications in order to attach a component to a workpiece or two workpieces together. In machines which automatically deliver rivets to a driving head, the driving head includes a carrier head in which the rivet is properly positioned and aligned prior to driving. One of the problems with the driving heads is that the rivets tend to get caught in the carrier head, making installation of the rivet into the workpieces difficult. Additionally, if the rivet is not properly positioned and served relative to the workpiece, it can jam the carrier. Since such machines are intended to be generally automated in terms of delivery of the rivet to the carrier head and installation of the rivet into the workpieces, jamming of such an automated machine dramatically reduces the operating efficiencies of such a system.

Many prior art devices tend to deliver rivets to a carrier head in an inconsistent manner. Such inconsistency in delivery of the rivets to the carrier head may produce jamming causing damage to machine components possibly resulting in production downtime. Additionally, many prior art devices provide much turbulence or movement during use, and this is undesirable.

The present invention is an improvement to the carrier head in order to control the position and orientation of rivets received therein, and to reduce turbulence and movement during use.

OBJECTS AND SUMMARY

A general object of an embodiment of the present invention is to provide a rivet carrier which is configured to prevent the jamming of rivets.

Another object of an embodiment of the present invention is to provide a rivet carrier which is configured such that turbulence and movement during use is reduced compared to some prior art devices.

Briefly, and in accordance with at least one of the foregoing objects, an embodiment of the present invention provides a rivet carrier for use in association with a driver for driving rivets into a work piece. The rivet carrier includes mounting structure for mounting the rivet carrier on the driver. A body portion of the rivet carrier is in communication with the mounting structure for receiving and retaining the rivet for engagement by the driver. Rollers are disposed in the body for retaining the rivet therein until the rivet is engaged by the driver and pushed past the rollers. The body has a longitudinal axis, and the rollers are angled relative to the longitudinal axis. There are pivotable arms in the body, and the pivotable arms are configured to engage the rivet therein. A resilient member retainably engages the pivotable arms. The rollers are retained in recesses in the body, and at least a portion of the pivotable arms defines the recesses. Preferably, a pair of outlet vents are provided in the body of the rivet carrier, and the outlet vents are configured to allow the venting of air which is used to drive the rivet. One outlet vent may be proximate the other outlet vent to create laminar air flow.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DESCRIPTION

Figure 1:
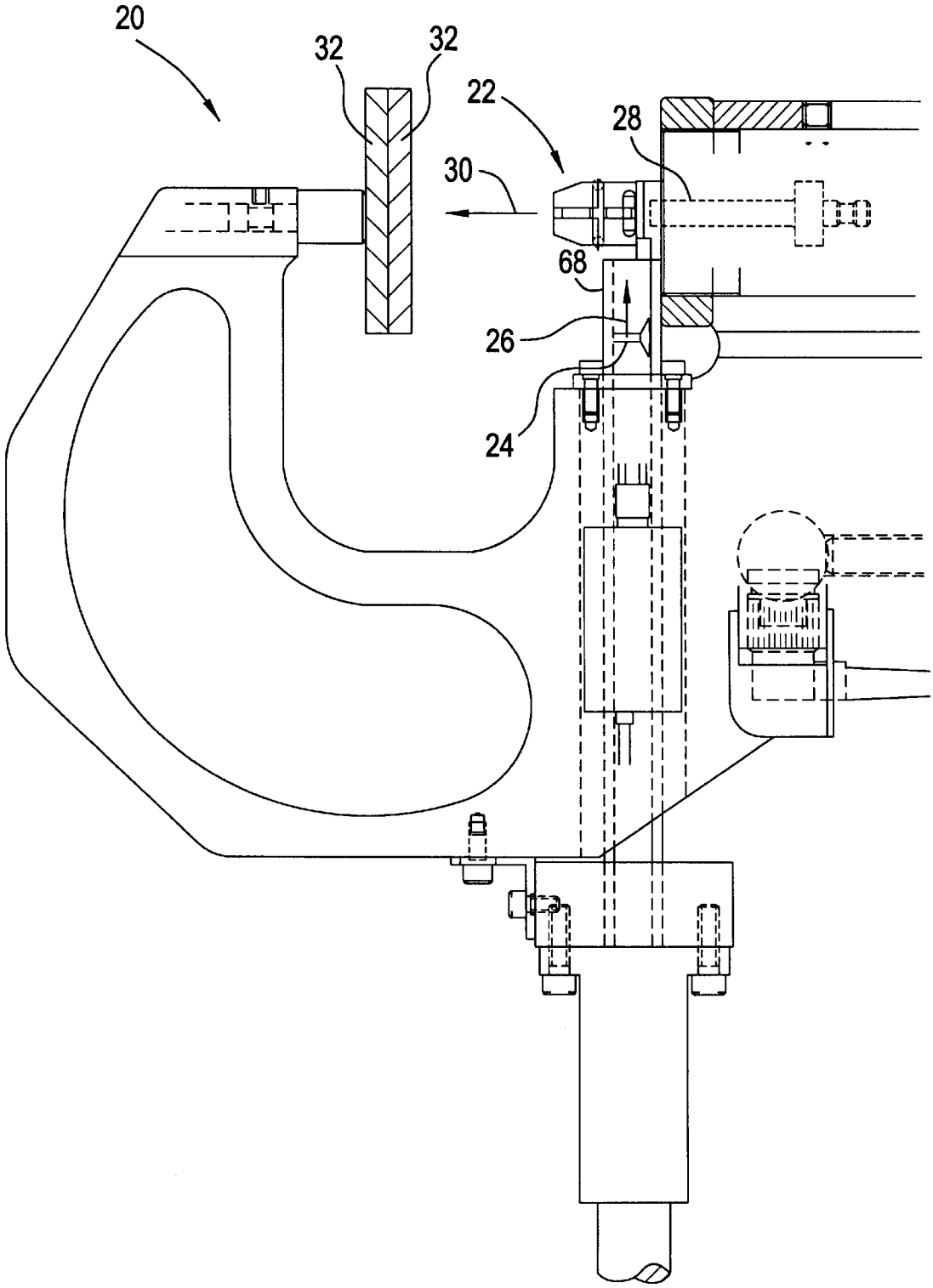
FIG. 1 is a view showing a riveting machine which includes a rivet carrier that is in accordance with an embodiment of the present invention.

While the present invention may be susceptible to embodiment in different forms, there is shown in the drawings, and herein will be described in detail, an embodiments thereof with the understanding that the present description is to be considered an exemplification of the principles of the invention and is not intended to limit the invention to that as illustrated and described herein.

With reference to FIGS. 1–6, a form of a riveting machine and carrier head are shown and described herein. With reference to FIG. 1, a riveting machine 20 is shown having a rivet carrier or carrier head 22 mounted thereon. The carrier head 22 receives rivets 24 which are delivered thereto along a path of travel 26. The rivets 24 are carried along the path of travel 26 by positive air flow traveling towards the carrier head 22.

The rivet 24 as shown and described herein is generally of a type having an enlarged head. A side elevational view of such a rivet defines a "T"-shaped configuration.

The machine 20 includes a driver 28 which drives the rivets 24 delivered to the carrier head into work pieces 32 along an axis 30. During the driving operation, the rivet 24 is retained in the carrier head 22 until it is appropriately served and positioned relative to the work pieces 32. Once the rivet is installed in the work pieces 32, the carrier head 22 returns to receive another rivet.

The carrier head 22 of the present invention includes improvements which allow the carrier head to receive and retain the rivet. The improvements prevent the rivet from jamming the carrier head and reduce turbulence and movement of the rivet within the carrier head 22.

Figure 3:
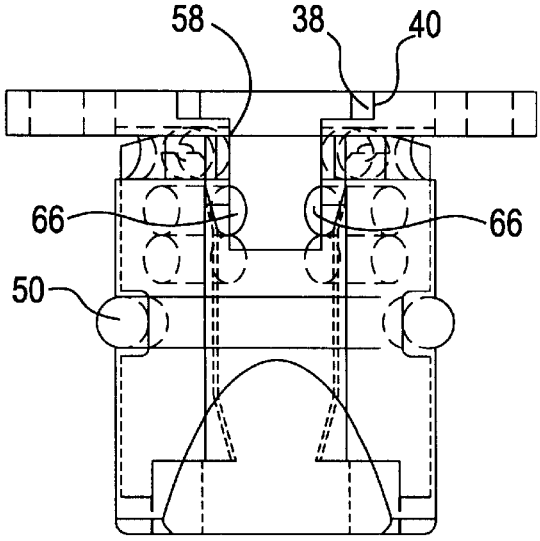
FIG. 3 is a front elevational view of the rivet carrier shown in FIG. 1.
Figure 4:
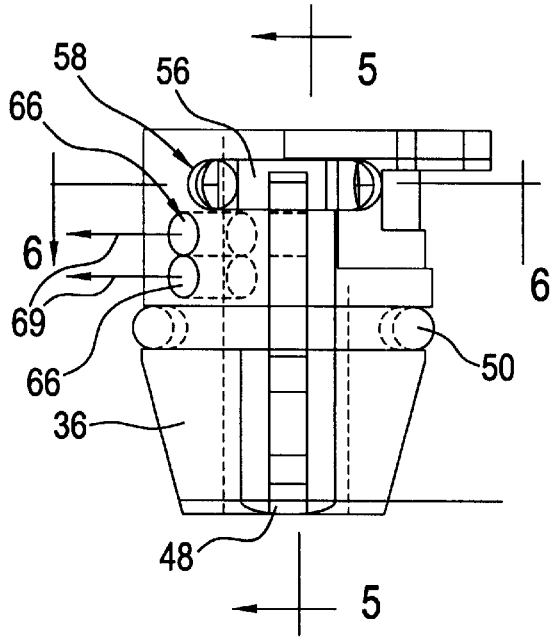
FIG. 4 is a right side elevational view of the rivet carrier shown in FIG. 1.
Figure 5:
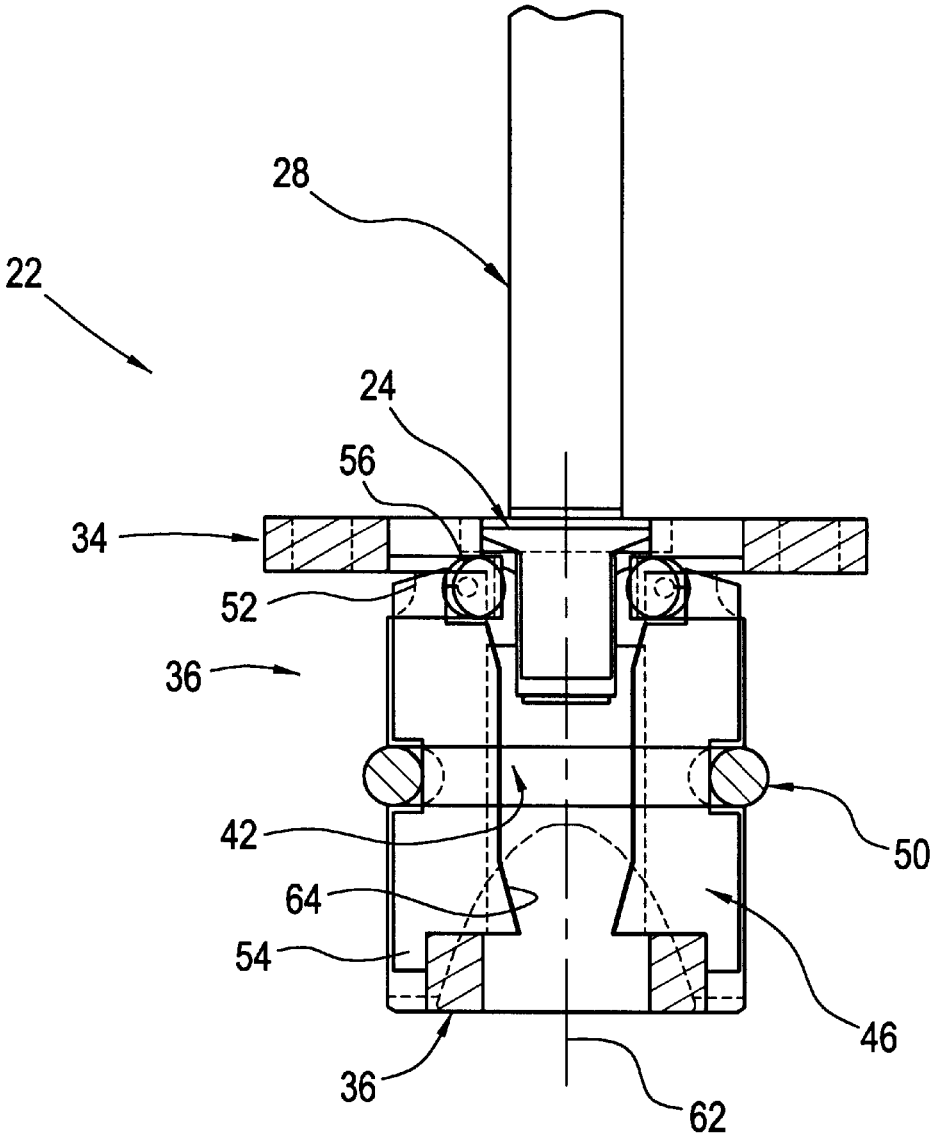
FIG. 5 is a partial fragmentary cross-sectional view of the rivet carrier taken along line 5—5 of FIG. 4.

With reference to FIGS. 2–6, various views of the carrier head are shown. The carrier head 22 includes a rivet receiving and head mounting plate 34. This attaches to a portion of or proximate to the driver 28. The carrier head 22 includes a positioning and retaining structure 36 approximate to the plate 34. A rivet is shown in FIG. 5 positioned within the carrier head 22 for installation.

Figure 2:
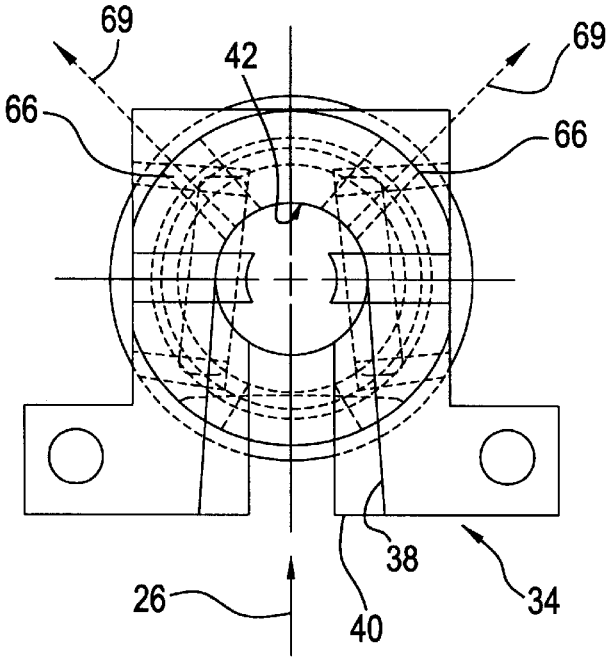
FIG. 2 is a top plan view of the rivet carrier shown in FIG. 1.

With reference to FIG. 2, the path of travel 26 indicates that the rivet is delivered generally axially relative to the plate 34. Walls 38 defining a mouth 40 of the plate 34 are tapered from the open end of the mouth 40 inwardly towards a driving passage 42. The tapered walls 38 facilitate proper transfer of the rivet to the carrier head 22 and alignment with the passage 42. It should be noted that with reference to FIG. 3, the walls 38 are tapered to accommodate the enlarged head of the rivet. It should be noted that the lower portion of the rivet also is received in an area in which the walls 44 are tapered inwardly also promoting proper transfer and alignment of the rivet in the driving passage 42.

The positioning and retaining portion or "body" includes a pair of pivotable arms 46 which are positioned generally opposite one another. The arms 46 are retained in corresponding channels 48 in the body 36. An O-ring or resilient holder 50 retains the arms 46 in the channels 48. Upper and lower extensions 52, 54 of the arms 46 abut corresponding structures to prevent inward movement of the arms 46. As such, the arms 46 are pivotally retained on the body 36 as described in the foregoing and will be further described hereinbelow.

Towards the upper portion of the body 36, a pair of generally oppositely positioned rollers 56 are retained in appropriately sized and dimensioned recesses 58. A portion of the recess 58 intersects the driving passage 42 to allow a portion of the roller 56 to extend into the diving passage 42. An inside edge of the recess relative to the driving passage 42 prevents inward movement of the roller 56 beyond a predetermined point. The upper portions 52 of the arms extend into the corresponding roller recesses 58 to prevent outward movement of the roller 56. The resilient holder 50 allows a degree of movement of the roller 56 such that, as described hereinbelow, as force is applied to the rivet, the rivet can push the rollers 56 outwardly relative to the driving passage 42. Once the rivet head has passed, the rollers are resiliently returned to the inward position as a result of the compressive force by the resilient holder 50.

It should be noted that it is envisioned that various constructions of the rollers, arms and resilient holder may be used to achieve the objectives of the present invention. As such, the structure and function of these features should be broadly interpreted.

Figure 6:
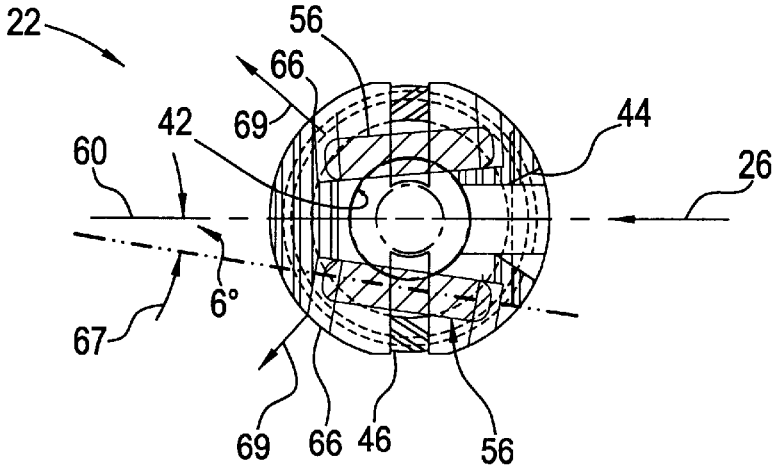
FIG. 6 is a partial fragmentary cross-sectional top plan view of the rivet carrier taken along line 6—6 of FIG. 4.

It should be noted that the rollers 56 as shown in FIG. 6 are angled relative to an axis 60. Preferably, the taper or angle 67 is in the range of 3 to 9 degrees, and as shown in FIG. 6, is most preferably approximately 6°. It is envisioned that the taper or angle may be selected as appropriate based on various parameters associated with the particular type of rivet, material, installation procedure as well as other factors. The angle on the rollers helps to align and retain the rivet once it is delivered to the carrier and driving passage 42. It should be noted that the driving passage generally has a diameter which is equal to or slightly larger than the diameter of the head of the rivet. This diameter can be achieved in the carrier head by movement of the rollers 56 and the arms 46. Nevertheless, the functional diameter of the passage 42 is equal to or slightly greater than the diameter of the head of the rivet 24.

The rivet head 24 is positioned above the rollers 56 (see FIG. 5) to retain the rivet in the desired position in the driving passage 42. The spring biased configuration and orientation of the rollers 56 relative to the rivet 24 allow a degree of retaining force on the rivet. The retaining force allows some degree of clamping by the driver 28 (shown diagrammatically) in FIG. 5 to be applied to the rivet head to retain it in position while the carrier head 22 is positioned relative to the workpieces 32.

Once the carrier head 22 is properly positioned relative to the workpieces, the driver 28 drives the rivet axially along the axis 62 to install the rivet into the workpieces. During the driving operation, the rivet is pushed past the rollers 56. This occurs when the driving force is greater than the inward spring force on the rollers. When this occurs, the rollers are pushed outwardly against the spring force created by the holder, thereby pivoting the upper portion 52 of the arms 46 outwardly as the rivet passes the rollers. As the rivet travels downwardly through the driving passage 42, it encounters inwardly sloped edges 64 of the arms 46. As it passes the edges 64, it pushes the rollers inwardly and pivots the lower portions 54 of the arms 46 outwardly.

With further reference to the FIGS. 2, 3, 4 and 6, outlet vents 66 are provided in the carrier proximate to and communicating with the driving passage 42. As described above, the rivet 24 is delivered to the carrier head 22 along a path of travel 26 by means of air flowing through a tube 68. When the air flow terminates at the driving passage 42, since the air cannot escape, it tends to create turbulence and move the rivet within the passage or cause the rivet to bounce back once it hits the carrier.

The carrier head 22 of the present invention includes the outlet vents 66 to exhaust the flow of air, as indicated by arrows 69 in FIGS. 2, 4 and 6, from the tube 68. By exhausting the air, the air generally does not circulate within the driving passage 42 and therefore generally does not have an effect on the rivet positioned therein. In fact, the exhausting of the air through the vents 66 tends to stabilize the position of the rivet relative to the driving passage 42. As shown in FIGS. 3 and 4, two pairs of outlet vents 66 are provided at spaced apart locations relative to the driving passage 42. These vents are located at an angle relative to the path of travel 26. The vents are sized and dimensioned to accommodate the air flow to prevent back flow of air or pressure within the driving passage 42. As shown in FIG. 4, the pair of vents on each side are generally spaced one above the other. This creates laminar air flow which helps retain the lower portion of the rivet generally axially aligned with the axis 62. The positive air flow against the rivet also retains the rivet against the smaller portion of the angled rollers 56. The angled rollers create a wedging effect against the lower portion of the rivet and retain the upper portion of the rivet thereagainst. The air flow helps maintain the wedging effect.

In use, a rivet 24 is carried through the tube 68 along the path of travel 26 by air flowing through the tube 68. The rivet 24 is delivered to the carrier head 22. As it approaches the carrier head, the rivet is guided in the transition from the tube to the carrier head by the angled walls 38 and 44. The rivet stops traveling when it becomes positioned against the rollers 56 in the driving passage 42. The rollers hold the rivet in position prior to insertion. The air flow flowing along the path of travel 26 is exhausted through the outlet vents 66 to help retain the orientation of the rivet within the driving passage against the rollers 56. The driver 28 drives against the rivet 24 to impose forces on it to drive it past the rollers 56. As forces increase, the rollers ultimately pivot outwardly to allow the rivet 24 to pass thereby against the inward forces of the resilient holder 50. The arms 46 are pivotable inwardly and outwardly to allow passage of the rivet as described above.

While embodiments of the present invention are shown and described, it is envisioned that those skilled in the art may devise various modifications of the present invention without departing from the spirit and scope of the appended claims.

What is claimed is:

1. A rivet carrier for use in association with a driver for carrying rivets for driving into a work piece using the driver, said rivet carrier comprising: mounting structure for mounting the rivet carrier on the driver; a body in communication with the mounting structure for receiving and retaining the rivet for engagement by the driver; pivotable arms in the body and configured to engage the rivet; a resilient member which retainably engages the pivotable arms; and rollers configured to engage the rivet, said rollers retained in recesses in the pivotable arms and configured to pivot the pivotable arms as the rivet passes thereby.

2. A rivet carrier as recited in claim 1, said body having a longitudinal axis, said rollers being angled relative to the longitudinal axis at an angle of between three and nine degrees.

3. A rivet carrier as recited in claim 2, wherein said rollers are angled relative to the longitudinal axis at an angle of six degrees.

4. A rivet carrier as recited in claim 1, further comprising at least one outlet vent in the body, said outlet vent configured to allow the venting of air which is used to drive the rivet.

5. A rivet carrier as recited in claim 1, further comprising a pair of outlet vents in the body, said outlet vents configured to allow the venting of air which is used to drive the rivet.

6. A rivet carrier as recited in claim 5, wherein one outlet vent is proximate the other outlet vent on the body.

7. A rivet carrier as recited in claim 1, wherein said resilient member comprises a single resilient member which retainably engages a plurality of said pivotable arms.

* * * * *